US005472833A

United States Patent [19]

Havens et al.

[11] Patent Number: 5,472,833

[45] Date of Patent: Dec. 5, 1995

[54] SILVER HALIDE PHOTOGRAPHIC FILM UTILIZING CELLULOSE TRIACETATE SUPPORT WITH TWO ANTISTATIC LAYERS

[75] Inventors: Charles T. Havens, Churchville; John E. Rieth, Penfield; Alfred B. Fant, Rochester; Raymond T. Jones, Webster, all of N.Y.

[73] Assignee: Eastman Kodak Company, Rochester, N.Y.

[21] Appl. No.: 227,169

[22] Filed: Apr. 14, 1994

[51] Int. Cl.[6] ..... G03C 1/825; G03C 1/85

[52] U.S. Cl. ..... 430/510; 430/527; 430/530

[58] Field of Search ..... 430/510, 527, 430/530

[56] References Cited

U.S. PATENT DOCUMENTS

| | | | |
|---|---|---|---|
| 2,932,855 | 4/1960 | Bartlett et al. . | |
| 4,203,769 | 5/1980 | Guestaux . | |
| 4,980,267 | 12/1990 | Taber | 430/382 |
| 5,006,451 | 9/1991 | Anderson et al. | 430/530 |
| 5,007,185 | 12/1991 | Cho et al. | 450/530 |
| 5,221,598 | 6/1993 | Anderson et al. | 430/530 |

*Primary Examiner*—Charles L. Bowers, Jr.
*Assistant Examiner*—Christopher G. Young
*Attorney, Agent, or Firm*—Robert A. Gerlach

[57] ABSTRACT

A process for making a photographic film support comprising applying a film forming coating composition containing an antistat agent to a first clear transparent polymeric film to form an antistat layer on the polymeric film and overcoating the free surface of the antistat layer with a second polymeric film having the same chemical composition as the first polymeric film.

4 Claims, No Drawings

SILVER HALIDE PHOTOGRAPHIC FILM UTILIZING CELLULOSE TRIACETATE SUPPORT WITH TWO ANTISTATIC LAYERS

BACKGROUND OF THE INVENTION

1. Field of the Invention

This invention relates to photographic elements and more particularly to photographic film supports for improved photographic elements.

2. Description of Related Art

Plasticized cellulose triacetate has found widespread use as a photographic support. These supports are prepared by casting a cellulose triacetate dope on a wheel or band and allowing the solvent to evaporate causing the sheet to cure to a point where it can be stripped from the casting surface for subsequent processing. In a refinement of this process a second layer of dope is applied to a previously cast triacetate sheet and subsequently dried to build a two-layer structure. The principal advantage is higher speeds for multi-layer casting relative to single-layer casting.

As a practical matter, photographic support must be recyclable. To simply discard normal manufacturing waste would be cost-prohibitive. A typical recovery cycle for flaked cellulose triacetate waste removes any emulsions or backing layers present in a sequence of wash and rinse cycles and then redissolves them in solvents to make a dope for casting. This dope must produce clear and homogenous support.

To overcome the problem of accumulation of static charges, it is conventional practice in the preparation of photographic elements to provide an antistatic layer. A wide variety of antistatic layers are known for use in photographic elements. One particularly useful antistatic agent described in U.S. Pat. No. 4,203,769 is vanadium pentoxide. This antistatic layer is commonly overcoated with a barrier layer in order to protect the antistat from degradation by photographic developing solutions. These overcoats can either be an outer backing layer of the film or can be in turn overcoated with additional functional layers such as the photographic emulsion layers.

These barrier layers or overcoats serve the function of preventing degradation of the antistat layer satisfactorily; however, they increase the complexity of the product and its manufacturing process, thus increasing the costs. Furthermore, the barrier properties of these layers for water in developer solutions imposes specific performance requirements which may interfere with other aspects of support performance. For example, hydrophobic layers can interfere with adequate draining of the film support during processing, thus leaving water marks on the developed images. Further, should it be desired to place the antistat layer on the emulsion side of the film support, it is generally necessary to include an adhesion promoting layer because emulsion layers have poor adhesion to hydrophobic layers.

In general, antistats used in photographic products are positioned at or near the surface to facilitate the dissipation of charge accumulated by transport through the manufacturing operations. While effective for this purpose, this location of the antistat layers renders its conductivity to be susceptible to being reduced or entirely eliminated by photographic developing solutions. An example of an antistat removed intentionally is the conductive carbon coating, also used as an antihalation layer, which is subsequently removed to permit projection. An example of an antistat layer, the conductivity of which is inadvertently reduced, is the ionic conductor poly(benzyltrimethylammonium chloride-coethyleneglycoldimethacrylat) which is used in various negative and positive image forming elements. Thus, there is a need for a permanent, process surviving antistat for photographic elements in order to reduce dirt accumulation on developed film negatives.

SUMMARY OF THE INVENTION

The invention provides a photographic film support and a photographic element on the film support having at least one silver halide light-sensitive layer, the film support being a clear, transparent, polymeric film having an upper surface and a lower surface and suspended between the upper and lower surfaces an antistatic layer.

The invention thus provides a photographic element having process surviving antistat capability with the concomitant advantage of reducing the number of layers necessary to achieve this function by prior art techniques, thus reducing the cost of the element.

DESCRIPTION OF THE PREFERRED EMBODIMENTS

The invention is most applicable to solvent cast photographic film supports such as, for example, cellulose triacetate, cellulose diacetate, cellulose acetate butyrate, cellulose nitrate, polystyrene, polyolefins, and the like which are readily cast from solvent solutions; therefore, these supports are preferred. However, the invention also is applicable to photographic film supports from polymers that are melt-cast such as, polyesters including polyethylene terephthalate, polyethylene naphthalate; polycarbonates, and the like.

In the preparation of a photographic film support by the solvent cast method, cellulose triacetate has been used extensively for this purpose and while other suitable materials can be employed as mentioned above, cellulose triacetate will be referred to herein for the purpose of simplicity. The cellulose triacetate is cast onto a suitable surface, such as a wheel or a continuous band in the form of a dope which is a solvent solution of the polymer. Any suitable technique can be employed for applying an antistat layer to the surface of the cellulose triacetate as cast, such as, co-casting in accordance with that taught in U.S. Pat. No. 2,932,855; wherein both the cellulose triacetate base support and the antistat layer are simultaneously cast through a suitable casting device as shown in that patent, to achieve a multilayer structure. In addition, a third layer over the antistat layer can be simultaneously cast in order to achieve the structure in accordance with this invention. Similarly, the first layer of the cellulose triacetate material can be cast onto the casting surface and the antistat layer and the second layer of the cellulose triacetate can be applied subsequently at casting stations removed from the initial casting stations. This is commonly referred to as multi-casting. In this technique, the antistat layer may be applied at one casting station and the second cellulose triacetate layer applied at a second multi-casting station. Alternatively, both layers may be applied to the initial cellulose triacetate layer at a single separate casting station wherein a suitable device as described in the above-mentioned patent is employed. Other suitable techniques for applying the various layers in accordance with this invention include, immersion roll coating, extrusion coating, gravure, and skim pan air knife.

In a preferred embodiment in accordance with this invention, a second antistat layer can be applied to either outer surface of the cellulose triacetate film. This is preferably done in line by a separate coating station or co-cast in combination with an inner cellulose triacetate or diacetate layer. It may be desirable to add lubricating agents to this second antistat layer. Further, the second antistat layer may be either process surviving or may be removed in the processing of the photographic element built on the above-described film support depending upon that being desired. For example, if the second antistat layer is to serve as an antihalation layer, it will be such that the processing of the photographic element will remove the layer as is currently employed in the development of motion picture films. A second antistat layer may be applied at any suitable position of a photographic element employing the support in accordance with this invention.

As mentioned above, the invention is also applicable in the preparation of melt-cast films such as polyesters and the like. In this technique, the normal procedure for the preparation of the film is employed wherein the melt-polymer, such as polyethylene terephthalate, is cast onto a surface, oriented by stretching in both the machine in the transverse direction and heat-treated to form a suitable film base. U.S. Pat. Nos. 4,042,569; 4,497,865; 4,617,164; and 5,093,064 described this technique. After the film is formed in accordance with the above, an antistat layer is applied thereto. It may be desirable or necessary to initially add to the film an adhesion promoting coat in order to enable the antistat layer to properly adhere thereto. This is commonly done in the preparation of polyester films such as polyethylene terephthalate and is at times applied to the polyester prior to or during the stretching steps. After the antistat layer is applied thereto, an overcoat of the same polymer which can be applied by any suitable technique including a solvent cast step of the polymer over the antistat layer. A second adhesion promoting layer may be necessary. As indicated above, the invention is particularly applicable to the preparation of solvent cast films because of the ease of preparation and of the number of steps that are necessary in the process of manufacture.

In the practice of this invention, any suitable antistat material may be applied as the intermediate layer or as the top layer of the film support in accordance with this invention such as the alkali metal salts of copolymers as disclosed in U.S. Pat. No. 3,033,679; alkali salts such as sodium or potassium chloride in polyvinyl alcohol binders as disclosed in U.S. Pat. No. 3,437,484; the combination of colloidal silica and an organic antistatic agent as disclosed in U.S. Pat. No. 3,525,621; ionic film forming polyelectrolytes as disclosed in U.S. Pat. No. 3,630,740; organic copolymers containing sulfonic acid groups as disclosed in U.S. Pat. No. 3,681,070; nonionic surface-active polymers and alkali metal salts as disclosed in U.S. Pat. No. 4,542,095; cross-linked styrene sulfonatemaleic acid copolymers as disclosed in U.S. Pat. No. 4,916,011; vanadium pentoxide antistatic agents as disclosed in U.S. Pat. No. 4,203,769; polyaniline salt-containing antistat layers as disclosed in U.S. Pat. Nos. 4,237,194; 4,308,332; and 4,526,706; quaternary ammonium polymer antistat layers as disclosed in U.S. Pat. No. 4,070,189; conductive metal oxides as disclosed in U.S. Pat. Nos. 4,394,441; 4,418,141; and 4,495,276; and the like. The coverage of the particular antistat material and the method of application set forth in the above patents may be employed in preparing the antistat layers in accordance with this invention. Each of the recited patents is incorporated herein by reference.

Photographic elements on film supports incorporating antistatic agents in accordance with this invention generally comprise at least one light-sensitive layer, such as a silver halide emulsion layer. This layer may be sensitized to a particular spectrum of radiation with, for example, a sensitizing dye, as is known in the art. Additional light-sensitive layers may be sensitized to other portions of the spectrum. The light-sensitive layers may contain or have associated therewith dye-forming compounds or couplers. For example, a red-sensitive emulsion would generally have a cyan coupler associated therewith, a green-sensitive emulsion would be associated with a yellow coupler. Other layers and addenda, such as overcoat layers with or without matte particles, subbing layers, surfactants, filter dyes, protective layers, barrier layers, development inhibiting releasing compounds, and the like can be present in photographic elements of the invention, as is well-known in the art. Detailed description of photographic elements and their various layers and addenda can be found in the above-identified *Research Disclosure* 17643 and in James, *The Theory of the Photographic Process,* 4th, 1977.

Photographic elements in accordance with this invention are disclosed in *Research Disclosure* 22534, January 1983, which is incorporated herein by reference. Further, the light-sensitive elements disclosed in U.S. Pat. No. 4,980,267, fully incorporated herein by reference, are particularly applicable to protection by the overcoat layers in accordance with this invention.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, the contents of which are incorporated herein by reference.

The invention will be further illustrated in the following examples:

EXAMPLE 1

A photographic support was prepared by placing a vanadium pentoxide antistat layer between two layers of cellulose triacetate. An antistat coating composition was prepared as follows:

| Antistat Coating Solution | |
|---|---|
| Acetone | 40.54% |
| Ethanol | 44.95% |
| Water | 14.36% |
| Cellulose Nitrate | 0.10% |
| Vanadium Pentoxide | 0.05% |

This coating was applied by immersion roll coating to a substantially cured, plasticized cellulose triacetate sheet whose final thickness was approximately 0.1 mm (0.004 inch) thick. The antistat composition was then dried to provide a dried weight of approximately 8.6 mg/m$^2$ (0.8 mg per square foot) of vanadium pentoxide. The web was then transported to an extrusion die where a layer of plasticized cellulose triacetate was applied over the vanadium oxide layer. When dried, this layer was approximately 0.001 inch thick. The dried composite structure was optically transparent. The resistivity of the composite structure was measured by the water electrode resistivity method (WER) and found to be $1.9\times10^9$ ohms per square, an acceptable value as an antistat for photographic applications. After photographic processing this resistivity was unchanged. The method of measuring resistivity is as follows:

A film support strip of known width and length (typically one inch by ten inches) is conditioned for a minimum of seventeen hours at 21° C. (70° F.) and 50% RH. The support strip is used to complete an electrical circuit by immersing its two ends into saline solutions acting as electrodes connected to a direct current voltage source and an ammeter. The internal resistivity of the film support is calculated by Ohm's law from the voltage and current readings and is reported in units of ohms per square.

EXAMPLE 2

The photographic film support prepared in Example 1 was evaluated for recovery and recycling of the film support. A portion of the support was chopped and then subjected to:

1) Caustic wash at 90.5° C. (195° F.)
2) Water rinse.
3) Sulfuric acid/potassium permanganate wash at 90.5° C. (195° F.)
4) Sodium bisulfite wash at 90.5° C. (195° F.)
5) Four fresh water rinses.
6) Dried.
7) Dissolved in a dope solvent mixture consisting of methylene chloride with minor components of methyl alcohol and butyl alcohol.

The dope was homogeneous and clear with a slight yellow hue. Photographic support cast from this dope was transparent and free from defects. While the dope can be filtered to remove particulates, this step was surprisingly unnecessary.

EXAMPLE 3

A photographic support dope was prepared by combining the following ingredients and mixing until homogeneous:

| | |
|---|---|
| Butyl Alcohol | 16.0grams |
| Methanol | 56.0grams |
| Methylene Chloride | 727.5grams |
| Triphenyl Phosphate | 18.6grams |
| Dimethoxyethylphthalate | 1.6grams |
| Cellulose Triacetate | 155.3grams |

This dope was cast by draw knife on a glass plate in a layer thirty mils thick while simultaneously applying the antistat coating solution of Example 1 by a second draw knife in a layer 18 μm (0.7 mil) thick over the uncured dope layer. The composite structure dried to provide a transparent support which could then receive a subsequent multicast layer if so desired.

EXAMPLE 4

A photographic support was prepared as in Example 1 and the back surface was subsequently coated with the lubricants set forth in Table 1 at approximately 5.3 mg/m$^2$ (0.5 mg/square foot):

TABLE I

Wax Coated on Cellulose Triacetate

| | Lubricant | Paper Clip Friction |
|---|---|---|
| SL92 | Polymeric Wax, Daniel Products Co. | 0.18 |
| SL280 | Polyethylene Wax, Daniel Products Co. | 0.29 |

TABLE I-continued

Wax Coated on Cellulose Triacetate

| | Lubricant | Paper Clip Friction |
|---|---|---|
| SL508 | Carnauba Wax, Daniel Products Co. | 0.21 |
| SL523 | Polymeric Wax, Daniel Products Co. | 0.24 |
| | Carnauba Wax | 0.20 |

The appearance of these supports were acceptable for the preparation of photographic elements.

Comparison supports were prepared by coating the antistat solution of Example 1 directly on cured cellulose triacetate support and then over coating with a barrier layer composed of 161 mg/m$^2$ cellulose diacetate (15 mg/ft$^2$), 53 mg/m$^2$ cellulose nitrate (5 mg/ft$^2$) and 21.5mg/m$^2$ of the lubricants (2 mg/ft$^2$) described in Table 2:

TABLE 2

Wax Coated as Internal Lubricant in Barrier Layer - Comparative

| Lubricant | Appearance |
|---|---|
| SL92 | Hazy |
| SL280 | Hazy |
| SL508 | Hazy |
| SL523 | Hazy |
| Carnauba Wax Type 3 | Hazy |

By directly coating a wax on the film support in accordance with this invention, compared to incorporating the wax as an internal lubricant in a barrier layer, the combination of good appearance and proper frictional properties are obtained. The hazy appearance of the coating is believed due to the incompatibility of the waxes and the barrier layer. Note that directly coating the wax on the barrier layer increases cost by requiring an additional coating station.

EXAMPLE 5

This example describes a film support utilizing two antistat layers, one to control surface charging characteristics, the other intended to provide process surviving antistat properties.

A photographic support as described in Example 1 was prepared to make film structures A and B having the lubricant as set forth in Table 3 coated on the backing surface. A second photographic film structure C was prepared by multi-casting two layers of triacetate without the intermediate antistat layer and coating with the lubricant of Table 3. Subsequently, the film support was evaluated for impact charge at 50% relative humidity, coefficient of friction and WER conductivity after photographic processing. The impact charge is determined as follows:

Conditioned, as in the test for resistivity, the film strip is passed through a static eliminator and the surface of interest is then impacted in a controlled fashion by an electrically isolated, stainless steel plunger. The amount of static charge developed on the impact head is measured and is related to the charge developed on the test surface. This impact charge is reported in microcoulombs per square meter. The greater the absolute value, the more likely the surface will cause charge separation in practical use. One of the two lubricants, potassium cetyl phosphate, is capable of dissipating charge as a result of ionic conduction in humid environments.

TABLE 3

| | Film Structure A | Film Structure B | Film Structure C |
|---|---|---|---|
| Film Base Lubricant (21.5 mg/m$^2$) | Conductive Potassium Cetyl Phosphate | Conductive Byk 331 (A silicone polyether) | Non-Conductive Potassium Cetyl Phosphate |
| Metal to Back Impact Charge (micro-coulomb per m$^2$) | −15 | −120 | −15 |
| C41 Processed WER (ohms/square) | $6.3 \times 10^8$ | $6.3 \times 10^8$ | $10^{12}$ |
| Coefficient of Friction | .24 | .20 | .24 |

In the impact charge testing, the lower the absolute value the more robust the static protection when the film is transported across ungrounded metal rollers. Thus, variations with the surface applied antistat are preferred in this regard. A WER conductivity of $10^9$ ohms per square or less is suitable as it will reduce dirt accumulated on developed negatives. The samples, in accordance with the invention, provide process surviving conductivity.

EXAMPLE 6

This example describes a film support utilizing two antistat layers, one intended to control surface charging characteristics while providing antihalation properties, the other intended to provide process surviving antistat properties.

A photographic support as described in Example 1 was prepared to make film structure A below. A second photographic film support was prepared by multi-casting two layers of triacetate without the intermediate antistat layer to make comparative film structure B. Subsequently, both film supports were coated with a conductive carbon composition well known in the photographic arts as described in U.S. Pat. No. 4,914,011, incorporated herein by reference, and evaluated for WER conductivity after photographic processing and the removal of the conductive carbon layer. Results are set forth in Table 4.

TABLE 4

| | Film Structure A | Film Structure B |
|---|---|---|
| Film Base Processed WER (ohms/square) | Conductive $6.3 \times 10^8$ | Non-Conductive $10^{12}$ |

Conductivity of $10^9$ ohms per square or less provides static protection to reduce the dirt accumulated on the film during handling and projection which is objectionable in the viewing of the film. This test shows the advantage of using a process surviving conductive film base in addition to the known surface applied conductive carbon composition.

EXAMPLE 7

A cellulose triacetate film support of Example 6A having an antihalation layer is coated with the following described layers in sequence (coverages are in grams per meter squared) on the other side of the cellulose triacetate support:

Adhesion Promoting Layer

This layer contains 0.05 g/m$^2$ cellulose nitrate and 0.10 g/m$^2$ gelatin.

Slow Cyan Dye-Forming Layer

This layer comprises a blend of red-sensitized, cubic, silver bromoiodide emulsion (1.5 mol percent iodide) (0.31 μm grain size) (1.16 g/m$^2$) and red-sensitized, tabular grain, silver bromoiodide emulsion (3 mol percent iodide) (0.75 μm diameter by 0.14 μm thick) (1.31), Compound J (0.965), Compound F (0.011), Compound L (0.65) and gelatin (2.96).

Fast Cyan Dye-Forming Layer

This layer comprises a red-sensitized, tabular grain silver bromoiodide emulsion (6 mol percent iodide) having a diameter of 1.40 μm and a thickness of 0.12 μm (0.807), Compound J (0.102), Compound K (0.065), Compound L (0.102) and gelatin (1.506).

Interlayer

This layer comprises Compound F (0.054), an antifoggant and gelatin (1.291).

Slow Magenta Dye-Forming Layer

This layer comprises a blend of green-sensitized tabular grain silver bromoiodide emulsion (3 mol percent iodide) (grain diameter 0.55 μm and a thickness 0.08 μm) (0.473) and tabular grain silver bromoiodide emulsion (3 mol percent iodide) (grain diameter 0.52 and thickness 0.09 μm) (0.495), Compound G (0.161), Compound I (0.108) and gelatin (2.916).

Fast Magenta Dye-Forming Layer

This layer comprises a blend of green-sensitized tabular grain silver bromoiodide emulsion (3 mol percent iodide) (grain diameter 1.05 μm and thickness 0.12 μm) (0.536) and tabular grain silver bromoiodide emulsion (3 mol percent iodide) (grain diameter 0.75 μm and thickness 0.14 μm), Compound G (0.258), Compound H (0.054) and gelatin (1.119).

Interlayer

This layer comprises Carey-Lea Silver (0.43), Compound F (0.054), an antifoggant and gelatin (0.861).

Slow Yellow Dye-Forming Layer

This layer comprises a blend of blue-sensitized tabular grain silver bromoiodide emulsions (3 mol percent iodide) (grain diameter 0.57 μm and thickness 0.12 μm) (0.274) and blue-sensitive silver bromoiodide emulsion (0.3 mol percent iodide) (grain diameter 0.52 μm and thickness 0.09 μm) (0.118), Compound C (1.022), Compound D (0.168) and gelatin (1.732).

Fast Magenta Dye-Forming Layer

This layer comprises a blue-sensitized tabular grain silver bromoiodide emulsion (3 mol percent iodide) (grain diameter 1.10 μm and thickness 0.12 μm) (0.43), Compound C (0.161), Compound D (0.054), Compound E (0.003) and gelatin (0.791).

UV Absorbing Layer

This layer comprises silver halide Lippmann emulsion (0.215), Compound A (0.108), Compound B (0.106) and gelatin (0.538).

Overcoat

This layer comprises insoluble silica coated vinyl toluene matte particles (0.038) and gelatin (0.888) as described in copending application Ser. No. 07/968,801 filed Oct. 30, 1992, assigned to that same assignee as this application and incorporated herein by reference.

The thus prepared photographic film is perforated in 35 mm format, exposed in a 35 mm camera and processed in a standard photofinishing processor. The processed film is printed in a standard photofinishing, high speed printer. The unexposed, exposed and developed film are free of defects due to the antistat layer. The WER conductivity of the photographic element before and after processing is substantially the same.
The structures of the above-designated Compounds A through L are as follows:
A:
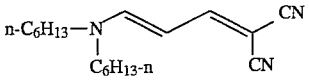
B:
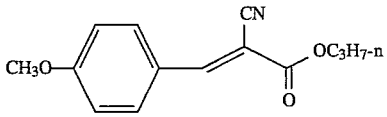
C:
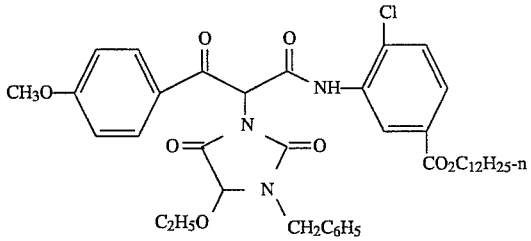
D:
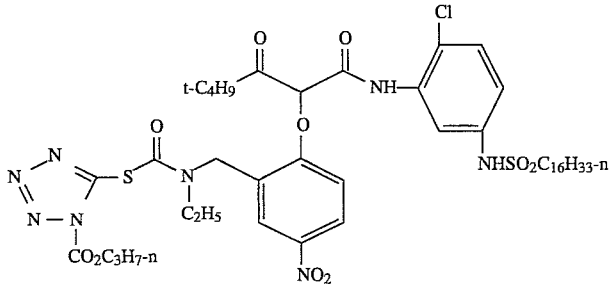
E:
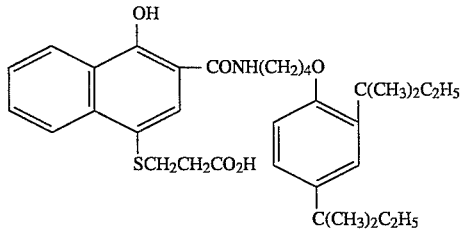
F:
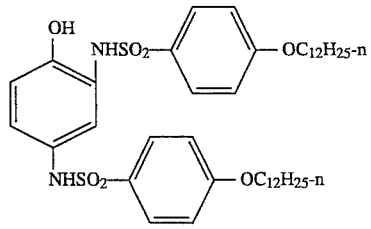
G:
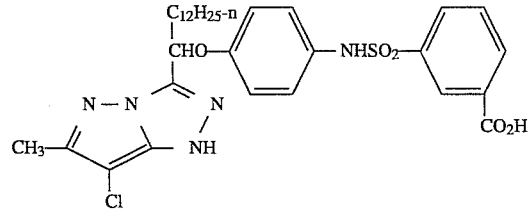

-continued
H:
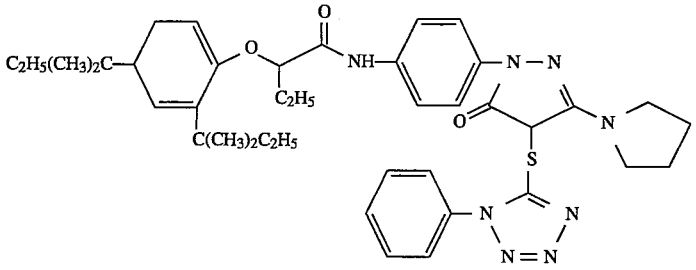
I:
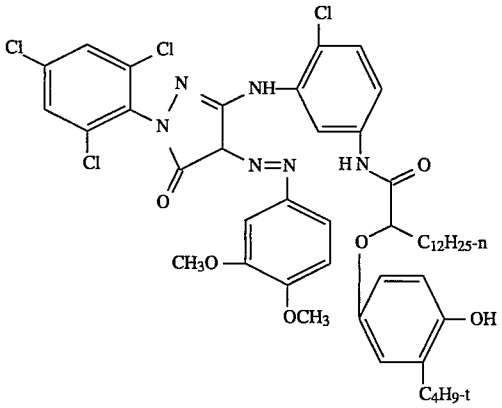
J:
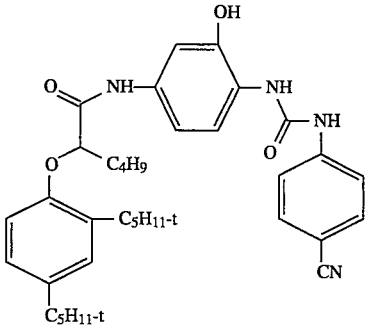
K:
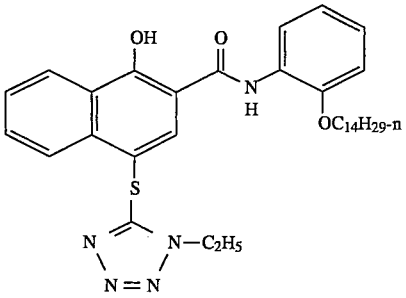
L:

-continued

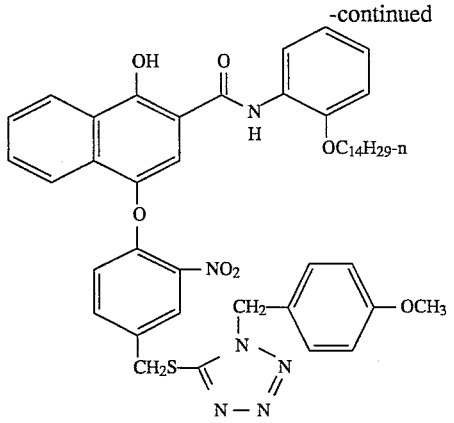

While there has been shown and described what are at present considered the preferred embodiments of the invention, it will be obvious to those skilled in the art that various changes, alterations and modifications may be made herein without departing from the scope of the invention as defined by the appended claims.

The invention has been described in detail with particular reference to preferred embodiments thereof, but it will be understood that variations and modifications can be effected within the spirit and scope of the invention.

What is claimed:

1. A photographic element having at least one light-sensitive silver halide layer on a support, the support comprising a first layer of cellulose triacetate, the first layer having an upper surface, and an outer surface, a second layer of cellulose triacetate, the second layer of cellulose triacetate having a lower surface, an antistatic layer between the upper surface of the first cellulose triacetate layer and the lower surface of the second cellulose triacetate layer and a second antistatic layer on the outer surface of the first cellulose triacetate layer.

2. The photographic element of claim 1 wherein the antistatic layer contains vanadium pentoxide.

3. The photographic element of claim 1 wherein the second antistatic layer contains a lubricating agent.

4. The photographic element of claim 1 wherein the second antistatic layer contains an antihalation agent.

* * * * *